United States Patent [19]

Murakami et al.

[11] Patent Number: 4,938,784

[45] Date of Patent: Jul. 3, 1990

[54] FOAMED ABRASIVE ELEMENT AND METHOD OF PRODUCING THE SAME

[75] Inventors: Shinji Murakami, Kyoto; Hikaru Horiuchi, Nara; Jiro Miyagawa; Yoriyasu Furukawa, both of Hyogo, all of Japan

[73] Assignee: Toa Seito Kogyo Kabushiki Kaisha, Japan

[21] Appl. No.: 255,543

[22] Filed: Oct. 11, 1988

[30] Foreign Application Priority Data

Jun. 26, 1986 [JP] Japan ..... 61-150171

[51] Int. Cl.[5] ..... B24D 3/00

[52] U.S. Cl. ..... 51/293; 51/296; 51/298

[58] Field of Search ..... 51/293, 296, 298

[56] References Cited

U.S. PATENT DOCUMENTS

| | | | |
|---|---|---|---|
| 3,495,960 | 2/1970 | Schladitz | 51/298 |
| 3,915,671 | 10/1975 | Kagawa | 51/296 |
| 3,976,525 | 8/1976 | Mednick | 51/298 |
| 4,331,453 | 5/1982 | Dau et al. | 51/298 |

*Primary Examiner*—Paul Lieberman
*Assistant Examiner*—Willie J. Thompson
*Attorney, Agent, or Firm*—Hill, Van Santen, Steadman & Simpson

[57] ABSTRACT

A foamed abrasive element comprises a bond of a cross-linked and hardened unsaturated polyester resin and abrasive grains dispersed in the bond and having a porosity of 10 to 80% and a compressive modulus of $10^2$ to $10^5$ kg/cm$^2$. A method of foamed abrasive element is also disclosed.

5 Claims, No Drawings

FOAMED ABRASIVE ELEMENT AND METHOD OF PRODUCING THE SAME

BACKGROUND OF THE INVENTION

1. Field of the Invention:

The present invention relates to a foamed abrasive element and to a method of producing the same.

2. Description of the prior arts:

Abrasive wheels which have been conventionally known include vitrified abrasive wheels, bakelite ones (resinoid ones), rubber ones, oxychloride ones, and synthetic resin ones containing unsaturated polyester resins. These abrasive wheels have a high compressive modulus and are rigid. Therefore they fully exhibit their performance in precision processing and heavy duty abrading but cannot provide ability close to that in abrading with endless belts typifying abrasive papers and cloths which are main products in abrasive processing. This is because the conventional abrasive wheels have high compressive modulus as given below and highly rigid and hence they are poor in following-up fitness to workpieces.

| Kind of abrasive wheel | Type No. | Compressive modulus ($kg/cm^2$) |
|---|---|---|
| Vitrified | WA120L | $7 \times 10^5$ |
| Abrasive Wheel | WA800K | $4 \times 10^4$ |
| Resinoid | WA120L | $3 \times 10^5$ |
| Abrasive wheel | C100H | $1.2 \times 10^4$ |

On the other hand, the compressive modulus of rigid rubber rollers of contact wheels for abrasive belts can have a wide range of $10^2$ to $10^5$ $kg/cm^2$ by varying the properties of the rigid rubbers. In general, although depending on materials and shapes of workpieces, the compressive modulus of the contact wheels for abrasive belts is about $10^3$ $kg/cm^2$ and can exhibit an excellent abrasive performance with following-up fittness. However, the abrasive papers and cloths (abrasive belts) cannot have the concentration of abrasive grains and the thickness of layer of abrasive grains as high as those of the abrasive wheels. Therefore they have a short useful life and must be exchanged frequently, which is not economical and leads to a long loss time. These defects are serious problems of the abrasive papers and cloths.

In order to eliminate the above noted defects, various attempts have been made until now. For example, there have been proposed an abrasive wheel comprising an abrasive material contained in a partial formal product of a PVA resin, an abrasive element in which fragments comprising melt spun fibrous materials with fine abrasive grains mixed therewith, are bonded together, an abrasive element made by forming into a various shapes, nonwoven fabric with abrasive material impregnated and bonded thereto, and an abrasive element which is prepared by impregnating a thermosetting resin in pores of an abrasive wheel of a partial formal product of a porous polyvinyl alcohol (e.g., abrasive wheel of a polyvinyl acetal resin) and then hardening the impregnated abrasive wheel to control the compressive modulus.

However, so far there have been no abrasive elements which has the properties of both abrasive wheels and abrasive papers and cloths.

Therefore, there has been a continuous research in the field of abrading and grinding to develop abrasive elements which are flexible like abrasive papers and cloths and have following-up fittness to workpieces, and in which cutting blades of abrasive elements can easily be reproduced and exchanged in order to maintain good sharpness of abrasive wheels.

The present inventors have made intensive studies on foamed abrasive elements and found that a foamed abrasive element comprising a bond of crosslinked and hardened unsaturated polyester resin and having a porosity and a compressive modulus in a certain range, has an excellent following-up fittness, abrasive efficiency, and autogenous action of cutting blade, and, in addition, possesses properties of both abrasive wheels and abrasive papers and cloths. As a resfult the present invention has been accomplished.

SUMMARY OF THE INVENTION

It is an object of the present invention to provide a foamed abrasive element which exhibits an excellent abrasive property and is provided with following-up fittness to workpieces.

This object is accomplished with a foamed abrasive element comprising a bond of a crosslinked and hardened unsaturated polyester resin and abrasive grains dispersed in the bond and having a porosity of 10 to 80% and a compressive modulus of $10^2$ to $10^5$ $kg/cm^2$.

The foamed abrasive element referred to in the present invention includes, in addition to an abrasive wheel, a sandpaper or the like which do not require safe strength.

DETAILED DESCRIPTION

It is essential that the porosity and the compressive modulus of the foamed abrasive element of the present invention are restricted to the ranges of 10 to 80% and $10^2$ to $10^5$ $kg/cm^2$, respectively. When the porosity and the compressive modulus each is lower than its lower limit, the following-up fittness is deteriorated, and when they each is higher than its upper limit, the abrasive efficiency is reduced and the production of the foamed abrasive element becomes difficult.

The abrasive grains dispersed in the bond in the foamed abrasive element of the present invention may be any materials used in the abrasive wheels. Examples of such abrasive grains include natural emery, manufactured abrasive materials, aluminum oxide ($\alpha$-crystal), silicon carbide, super abrasive grains such as diamond and CBN, and highly hard carbides, nitrides, borides and composite oxides.

The unsaturated polyester resin in the present invention may be modified with a polyurethane and/or a thermo-setting resin such as a resol-type phenol resin.

By this modification the heat resistance and the abrasive properties of the foamed abrasive element are further improved.

The foamed abrasive element of the present invention is produced in the following method. The method comprises preparing a mixture containing at least an unsaturated polyester resin, a crosslinking agent and a hardening agent therefor, abrasive grains, and a foaming agent, and foaming and hardening the mixture, to produce a foamed abrasive element having a porosity of 10 to 80% and a compressive modulus of $10^2$ to $10^5$ $kg/cm^2$.

The mixture used in the method of the present invention may further contain a polyurethan resin and/or a thermosetting resin such as a resol-type phenol resin. The phenol resin, which is normally incompatible with the unsaturated polyester resin, can foam a homogeneous hardened product as a bond by foaming and hardening together with the unsaturated polyester resin.

The unsaturated polyester resin used in the present invention is a conventional liquid resin, in which an unsaturated polyester obtained by a polycondensation reaction of an unsaturated organic dicarboxylic acid such as maleic acid and fumaric acid, with a polyhydric alcohol such as ethylene glycol, diethylene glycol, triethylene glycol, propylene glycol and 1,3-butylene glycol, is dissolved in a crosslinking liquid monomer such as styrene, vinyltoluene, acrylic acid ester and methacrylic acid ester.

The liquid resin may contain conventional accelerator for hardening and polymerization inhibitor, and, in addition, modifiers which impart the flame-retardancy, air-drying property, light-resistance, and flexibility to the product.

The foaming agent used in the method of the present invention may be any one which is conventional used for foaming unsaturated polyester resins. Examples of the foaming agent include nitrogen gas, carbon dioxide gas and air as a gas; pentane, hexane, heptane, butene, $CFCl_3$ and $C_2F_3Cl_3$ as a low-boiling solvent; a mixture of toluene diisocyanate, 4,4'-diphenylmethane diisocyanate, hexamethylene diisocyanate, or polyurethane prepolymer, which react with water to generate carbon dioxide gas, with water or their mixture; a decomposition-type foaming agent such as ammonium carbonate, ammonium bicarbonate, sodium bicarbonate, dinitropentamethylenetetramine, azodicarbonamide, azobisisobutylonitrile, hydradine compounds such as maleic acid hydrazide, oxalic acid hydrazide, benzenesulfonyl hydrazide, toluenesulfonyl hydrazide, p,p'-hydroxybis(benzenesulfonylhydrazide), t-alkylhydrazonium salt and a monosubstituted sulfonyl hydrazide represented by formula $PSO_2NHNH_2$ wherein R represents a $C_1$ to $C_{12}$ alkyl group or a $C_5$ or $C_6$ cycloalkyl; and a mixtures of these hydrazine compounds with at least one inorganic powder compound selected from a group consisting of a percarbonate, perborate and perphosphate.

By controlling the kind and amount of the foaming agent and the conditions of foaming, the desired rate of foaming, that is, the desired porosity and compressive modulus can be obtained.

The hardening agent used in the method of the present invention may be the conventionally used peroxide. Examples of the hardening agent include organic peroxides such as methyl ethyl ketone peroxide (MEKPO), benzoyl peroxide and hydroperoxide, and hydrogen peroxide.

In the method of the present invention, the conventional known production method of foamed unsaturated polyester resin products can be used as foaming and hardening method.

For example, there may be mentioned a method in which nitrogen gas, carbon dioxide gas or air is forced into a liquid resin at normal pressure or under pressure, for forming air bubbles, a method in which fine water particles are dispersed in a polyester resin and the resulting water-containing polyester resin is foamed, and a method in which a low-boiling solvent is mixed with a resin and the solvent is evaporated to foam the resin.

Moreover, JP-A-54-15607 and JP-B-58-45457 disclose a foaming method in which an isocyanate and water are used for generating carbon dioxide gas (the term "JP-A" as used herein means an unexamined published Japanese patent application and the term "JP-B" as used herein means an examined Japanese patent publication) In this case, the isocyanate, hydroxyl compound, and urethane prepolymer can be used for improving the physical properties of the bond in the foamed abrasive element by utilizing as a bond the resulting foamed product.

Examples of the method using a decomposition-type foaming agent include:

(a) a method in which an unsaturated polyester resin is mixed with a heat-foaming agent, a hardening agent, and a substance which react with the terminal carboxyl group of the unsaturated polyester to form a salt, to obtain a high viscosity mixture, and the resulting mixture is heated to foam (JP-B-48-29861);

(b) a method in which an unsaturated polyester resin is mixed with a substituted sulfonylhydrazide foaming agent, an organic peroxide compound, an organometal catalyst, and a surfactant and the resulting mixture is foamed and hardened (JP-B-58-49577);

(c) a method in which an unsaturated polyester resin is mixed with a tert-alkylhydrazonium salt foaming agent, a peroxide, and a transition metal accelerator, for foaming and hardening the polyester resin (JP-A-59-81346); and (d) a method in which an unsaturated polyester resin is mixed with a percarbonate and a hydrazide compound to foam and hardened the polyester resin (JP-B-58-29330).

The present invention is described in detail with reference to the following examples but is not to be construed as being limited to the examples.

EXAMPLES 1 to 3

To 1 kg of a liquid unsaturated polyester resin (Esta R-130B manufactured by Mitsui-Toatsu Co. Ltd.; used for general laminate; viscosity, 25 to 40 poises at 25° C.) were added 10 g of a metal salt of naphthenic acid (cobalt content, 6%) and 45 g of toluenesulfonyl hydrazide. To the mixture was added 2.5 kg of abrasive grains (green silicon carbide #20) under stirring. The mixture was stirred with a propeller mixer, well enough to be uniform. To the resulting mixture were added 100 g of sodium percarbonate, 30 g of water and a hardener, MEKPO (active ingredient 55%). The mixture was stirred for 30 to 60 seconds with a propeller rotor capable of uniformly dispersing and mixing in a short time. The mixture was then charged into a grinding wheel casting mold with an outer diameter of 255 mm, a thickness of 30 mm and an inner diameter of 35 mm. The mold was then left to stand at room temperature (20°±5° C.). About 2 to 10 minutes later, the mixture in the mold began to foam and then gradually hardened. After hardening and after curing at 50° to 180° C. for 2 to 10 hours, a foamed abrasive element of Example 1 was prepared.

Two other abrasive elements were prepared in the same manner as in Example 1 but varying the amounts of toluenesulfonyl and sodium percarbonate of Examples 2 and 3.

For comparison Example, a comparative sample was prepared in the same manner as in Example 1 but omitting toluenesulfonyl hydrazide and sodium percarbonate.

Properties as an abrasive wheel of the foamed abrasive element of Examples 1 to 3 and a comparative sample are shown in Table 1, together with the amounts used of toluenesulfonyl hydrazide and sodium percarbonate. The peripheral speed for rotational destruction and the ultrasonic transmission speed of the foamed abrasive elements of Examples 1 to 3 and the comparative samples are shown in Table 2.

The foamed abrasive elements of Examples 1 to 3 were excellent as compared with the comparative sample and also had better following-up fittness to workpieces.

TABLE 1

| | Toluenesulfonyl Hydrazide (g) | Sodium Percarbonate (g) | Percentage of Abrasive Grains vol (%) | Percentage of Bond vol (%) | Porosity vol (%) | Bulk Specific Gravity | Compressive Modulus (kg/cm$^2$) |
|---|---|---|---|---|---|---|---|
| Comparison Example | — | — | 46.4 | 46.0 | 7.6 | 1.77 | $8.8 \times 10^3$ |
| Example 1 | 45 | 100 | 22.5 | 26.0 | 51.5 | 1.00 | $7.8 \times 10^2$ |
| Example 2 | 25 | 50 | 32.1 | 37.1 | 30.8 | 1.43 | $1.6 \times 10^3$ |
| Example 3 | 90 | 200 | 15.9 | 18.4 | 65.7 | 0.71 | $3.2 \times 10^2$ |

TABLE 2

| | Ultrasonic Transmission Speed (mm/μsec) | Peripheral Speed for Rotational Destraction (m/min) | Stock Removal (g) | Abrasion Wear of Abrasive Wheel (g) | Abrasive Load (Kg) | Abrasive Ratio | Abrasive Efficiency (g/min) | State of Abrading Surface |
|---|---|---|---|---|---|---|---|---|
| Comparison Example | 2.69 | 8,540 | 10 | 0.8 | 10 | 12.50 | 1.0 | Backish after 2 minutes |
| Example 1 | 2.11 | 6,060 | 62 | 9.0 | 5 | 6.89 | 6.2 | Continuous sparks, good |
| Example 2 | 2.25 | 7,000 | 56 | 4.2 | 7 | 13.33 | 5.6 | Slightly blackish after 10 minutes |
| Example 3 | 1.84 | 5,500 | 90 | 45 | 4 | 2.0 | 9.0 | Some portions chipped off |

The condition used for measuring abrasive characteristics are shown in Table 3.

TABLE 3

| | |
|---|---|
| Grinding Machine | Traverse Plane Grinding Machine |
| Dimensions of Abrasive Wheel | Outer diameter 255 × thickness 25 × inner diameter 25.4 (m/m) |
| Material to be Abraded | S-55-C High frequency hardened product HRC 58 |
| Rate of Movement of Material to be Abraded | 7.0 m/min |
| Abrading Time | 10 minutes |
| Abrading Liquid | Water |
| Peripheral Speed of Abrasive Wheel | 2,000 m/min |
| Ultrasonic Frequency | 200 kHz |

EXAMPLES 4 and 5

To 1 kg of the unsaturated polyester resin used in Example 1 were added 50 g of sodium percarbonate, 50 g of water, and 50 g of a foam stabilizer (silicone F-305 used for rigid polyurethane foams and manufactured by Shin-etsu Kagaku Co., Ltd.). The mixutre was stirred with a propeller mixer for 2 minutes. To the mixture was then added 2 kg of abrasive grains (green silicon carbide, JIS 4c#120). To the mixture was added, under well stirring, 100 g of diphenylmethane-4,4'-diisocyanate (crude MDI, Hicell 122P manufactured by Toho Kagaku Kogyo K.K.) and then 40 g of a hardener MEKPO (active ingredient 55%). After 1 minute of the stirring, the mixture was charged into a casting mold and allowed to foam and harden.

Then, the foamed product was subjected to after cure at 80°±5° C. for 10 hours to obtain a foamed abrasive element of Example 4.

The procedures of Example 4 were repeated but increasing the amount used of the crude MDI to 200 g, to obtain a foamed abrasive element of Example 5, which was more porous than the foamed abrasive element of Example 4.

Properties as an abrasive wheel and some of abrasive characteristics of the foamed abrasive elements of Examples 4 and 5 are shown in Table 4. (Abrasive conditions were the same as shown in Table 3).

TABLE 4

| | Percentage of Grains vol (%) | Percentage of Bond vol (%) | Porosity vol (%) | Bulk Specific Gravity | Compressive Modulus (kg/cm$^2$) | Ultrasonic Transmission Speed (mm/μsec) | Peripheral Speed for Rotational Destruction (m/min) |
|---|---|---|---|---|---|---|---|
| Example 4 | 17.3 | 27.6 | 55.1 | 0.91 | $5.9 \times 10^2$ | 1.92 | 8,820 |
| Example 5 | 12.9 | 22.5 | 64.6 | 0.70 | $3.8 \times 10^2$ | 1.76 | 7,920 |

The foamed abrasive elements of Examples 4 and 5 each using diphenylmethane-4,4'-diisocyanate were highly porous and had a high peripheral speed for rotational destruction indicating the safety factor being excellent. It is considered that the polyester resin reacts with crude MDI in the following scheme (1):

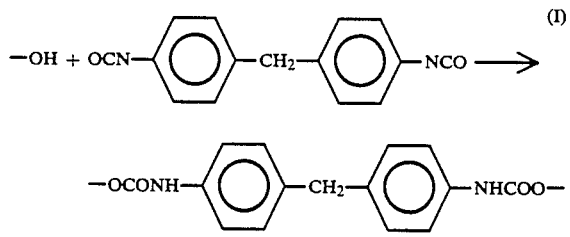

and this reaction gives a new bond having an excellent bonding strength.

EXAMPLES 6 to 8

To 90 g of the unsaturated polyester used in Example 1 were added 100 g of a resol-type phenol resin (BRL-218Z; non volatile matter, at least 70%; viscosity 400 to 500 cps; gel time, 120 to 130 sec; manufactured by Showa-Kobunshi K.K.) and then 15 g of dimethylaniline while stirring, to obtain a uniform dispersion. To the dispersion were added 100 g of sodium bicarbonate and 1,500 g of abrasive grains (GC#120). The mixture was stirred for 5 minutes and then 20 g of an aqueous solution of paratoluenesulfonic acid (70%) and 20 g of benzoyl peroxide. After 30 seconds, the mixture was poured into the casting mold used in Example 1 and hardened. The hardened mixture was then aftercured for 10 hours to obtain a foamed abrasive element of Example 6.

The procedures of Example 6 were repeated but using 800 g of the unsaturated polyester resin, 200 g of the resol-type phenol resin, 10 g of dimethylaniline, and 60 g of benzoyl peroxide, to obtain a foamed abrasive element of Example 7.

The procedures of Example 6 were repeated but using 700 of the unsaturated polyester resin, 300 g of the resol-type phenol resin, 10 g of dimethylaniline, 200 g of sodium bicarbonate, 40 g of an aqueous solution of paratoluenesulfonic acid (70%), and 60 g of benzoyl peroxide, to obtain a foamed abrasive element of Example 8.

Properties as an abrasive wheel and some of abrasive characteristics of the foamed abrasive elements of Examples 6 to 8 are shown in Table 5, and the conditions used for measuring abrasive characteristics are shown in Table 6.

TABLE 5

| | Percentage of Abrasive Grains vol (%) | Percentage of Bond vol (%) | Porosity vol (%) | Bulk Specific Gravity | Compressive Modulus (kg/cm$^2$) | Stock Removal (g) | Abrasion Wear of Abrasive Wheel (g) | Abrasive Ratio | Abrasive Efficiency (g/min) |
|---|---|---|---|---|---|---|---|---|---|
| Example 6 | 27.3 | 15.6 | 57.1 | 0.78 | $1.4 \times 10^3$ | 110 | 2.4 | 45.8 | 11 |
| Example 7 | 26.2 | 14.9 | 58.9 | 0.75 | $2.2 \times 10^3$ | 87 | 1.6 | 54.4 | 8.7 |
| Example 8 | 26.6 | 16.5 | 56.9 | 0.79 | $3.7 \times 10^3$ | 62 | 0.7 | 88.6 | 6.2 |

TABLE 6

| | |
|---|---|
| Dimensions of Abrasive Wheel | Outer diameter 255 × Thickness 25 × Inner diameter 25.4 (m/m) |
| Material to be Abraded | Phenol-asbestos laminate |
| Rate of Movement of Material to be Abraded | 7 m/min |
| Abrading Time | 10 minutes |
| Abrading Method | dry |
| Peripheral Speed of Abrading Wheel | 2,000 m/min |

The results in Table 5 indicate that the foamed abrasive elements (abrasive wheels) of Examples 6 to 8 have greatly improved heat resistance as compared with the conventional abrasive wheel. This improvement is considered to attribute to the interpenetrating network polymer formed, through the foaming and hardening, between the unsaturated polyester resin and the phenol resin, which is generally not appreciably reacted and not compatible with the unsaturated polyester resin.

According to the present invention the foamed abrasive element comprises a bond of a crosslinked and hardened unsaturated polyester resin and abrasive grains dispersed in the bond and has a porosity of 10 to 80% and a compressive modulus of $10^2$ to $10^5$ kg/cm$^2$.

Therefore, the present invention can provide a new foamed abrasive element which is useful for both abrading and grinding and which has both excellent sharpness as an abrasive wheel and flexible following up fittness to workpieces characteristic to an abrasive paper and cloth.

Also, according to the present invention the above-mentioned foamed abrasive element is produced by preparing a mixture containing at least an unsaturated polyester resin, a crosslinking agent and a hardening agent therefor, abrasive grains, and a foaming agent, and foaming and hardening the mixture.

Therefore, the porosity and the compressive modulus of the foamed abrasive element can be adjusted to a desirable level.

In addition, according to the present invention, because the mixture prepared above may contain a polyurethane resin and/or a thermosetting resin, the heat resistance and abrading performances of the foamed abrasive element can further be improved.

What is claimed is:

1. A foamed abrasive element comprising a bond of a crosslinked and hardened unsaturated polyester resin modified with a thermosetting resin selected from the group consisting of polyurethane resin, resol-type phenol resin and mixtures thereof and abrasive grains dispersed in the bond and having a porosity of 10 to 80% and a compressive modulus of $10^2$ to $10^5$ kg/cm$^2$.

2. A method of producing a foamed abrasive element which comprises preparing a mixture containing at least an unsaturated polyester resin modified with a thermosetting resin selected from the group consisting of polyurethane resin, resol-type phenol resin and mixtures thereof, a crosslinking agent and a hardening agent therefor, abrasive grains, and a foaming agent, and foaming and hardening the mixture, to produce a foamed abrasive element having a porosity of 10 to 80% and a compressive modulus of $10^2$ to $10^5$ kg/cm$^2$.

3. A method as in claim 1, wherein the mixture further contains a thermosetting resin.

4. The method of claim 2 wherein the foaming agent is a chemically composable foaming agent.

5. The method of claim 3 wherein the foaming agent is a chemically composable foaming agent.

* * * * *